US011846165B2

(12) United States Patent
El Mallawany et al.

(10) Patent No.: US 11,846,165 B2
(45) Date of Patent: Dec. 19, 2023

(54) FLUID FLOW CONTROL SYSTEM WITH A WIDE RANGE OF FLOW

(71) Applicant: Halliburton Energy Services, Inc., Houston, TX (US)

(72) Inventors: Ibrahim El Mallawany, Dhahran (SA); Ryan Wesley McChesney, Prosper, TX (US); Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/127,126

(22) Filed: Dec. 18, 2020

(65) Prior Publication Data

US 2022/0195850 A1 Jun. 23, 2022

(51) Int. Cl.
*E21B 43/12* (2006.01)
*E21B 34/06* (2006.01)

(52) U.S. Cl.
CPC ..... *E21B 43/12* (2013.01); *E21B 34/06* (2013.01)

(58) Field of Classification Search
CPC ..... E21B 43/12; E21B 34/06
See application file for complete search history.

(56) References Cited

U.S. PATENT DOCUMENTS 5,145,256 A * 9/1992 Wiemers ..... E21B 21/065 366/336
10,214,991 B2 * 2/2019 van Petegem ..... E21B 34/08
10,494,904 B2 * 12/2019 Frosell ..... E21B 47/12
10,626,702 B2 4/2020 Ornelaz et al.
2011/0030969 A1 * 2/2011 Richards ..... E21B 34/14 166/373
2011/0198097 A1 8/2011 Moen
2013/0186634 A1 7/2013 Fripp et al.
2015/0040990 A1 * 2/2015 Mathiesen ..... E21B 34/08 137/12
2015/0060084 A1 * 3/2015 Moen ..... E21B 43/12 166/373
2019/0010783 A1 1/2019 Frosell et al.

FOREIGN PATENT DOCUMENTS

CN 109964003 A 7/2019
WO 2015031745 A1 3/2015

* cited by examiner

*Primary Examiner* — Aaron L Lembo
(74) *Attorney, Agent, or Firm* — Scott Richardson; Parker Justiss, P.C.

(57) ABSTRACT

Provided is a fluid flow control system and a well system. The fluid flow control system, in one aspect, includes a fluid nozzle operable to receive production fluid having a pressure (P3) and discharge control fluid having a control pressure (P2). The fluid flow control system, in accordance with this aspect, further includes an inflow control device having a production fluid inlet operable to receive the production fluid having the pressure (P3), a control inlet operable to receive the control fluid having the control pressure (P2) from the fluid nozzle, and a production fluid outlet operable to pass the production fluid to the tubing, the inflow control device configured to open or close the production fluid outlet based upon a pressure differential value (P3–P2). The fluid flow control system, in another aspect, includes a flow regulator coupled to the inflow control device, the flow regulator configured to regulate a pressure drop (P3–P1) across the production fluid inlet and the production fluid outlet.

20 Claims, 6 Drawing Sheets

FLUID FLOW CONTROL SYSTEM WITH A WIDE RANGE OF FLOW

BACKGROUND

In hydrocarbon production wells, it may be beneficial to regulate the flow of formation fluids from a subterranean formation into a wellbore penetrating the same. A variety of reasons or purposes may necessitate such regulation including, for example, prevention of water and/or gas coning, minimizing water and/or gas production, minimizing sand production, maximizing oil production, balancing production from various subterranean zones, and equalizing pressure among various subterranean zones, among others.

A number of devices and valves are available for regulating the flow of formation fluids. Some of these devices may be non-discriminating for different types of formation fluids and may simply function as a "gatekeeper" for regulating access to the interior of a wellbore pipe, such as a production string. Such gatekeeper devices may be simple on/off valves or they may be metered to regulate fluid flow over a continuum of flow rates. Other types of devices for regulating the flow of formation fluids may achieve at least some degree of discrimination between different types of formation fluids. Such devices may include, for example, tubular flow restrictors, nozzle-type flow restrictors, autonomous inflow control devices, non-autonomous inflow control devices, ports, tortuous paths, and combinations thereof.

BRIEF DESCRIPTION

Reference is now made to the following descriptions taken in conjunction with the accompanying drawings, in which.

DETAILED DESCRIPTION

Figure 1:
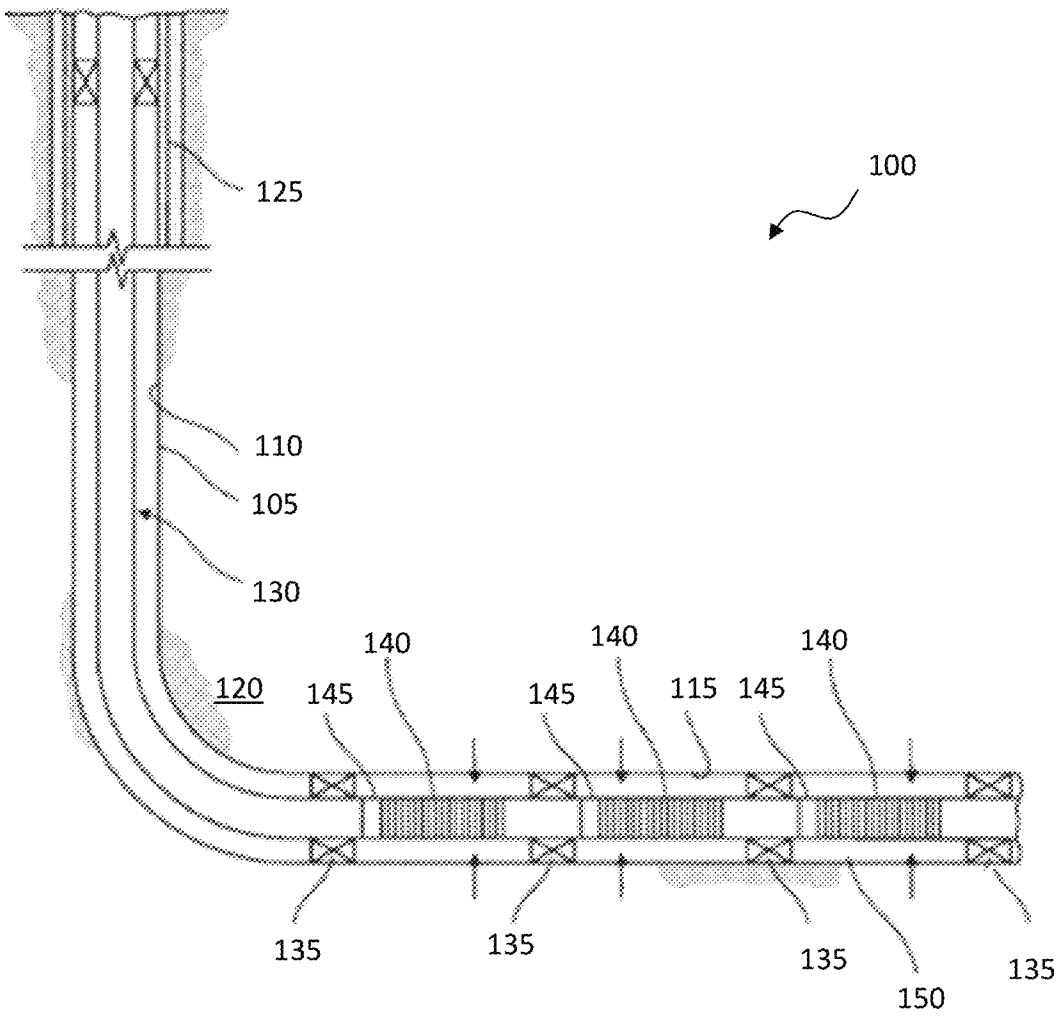
FIG. 1 illustrates a schematic view of a well system designed, manufactured and operated according to one or more embodiments of the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the ground; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

FIG. 1 illustrates a schematic view of a well system designed, manufactured and operated according to one or more embodiments of the disclosure. The well system 100 may include a wellbore 105 that comprises a generally vertical uncased section 110 that may transition into a generally horizontal uncased section 115 extending through a subterranean formation 120. In some examples, the vertical section 110 may extend downwardly from a portion of wellbore 105 having a string of casing 125 cemented therein. A tubular string, such as production tubing 130, may be installed in or otherwise extended into wellbore 105.

In the illustrated embodiment, one or more production packers 135, well screens 140, and fluid flow control systems 145 may be interconnected along the production tubing 130. In most systems, there are at least two sets of production packers 135, well screens 140, and fluid flow control systems 145 interconnected along the production tubing 130. The production packers 135 may be configured to seal off an annulus 150 defined between the production tubing 130 and the walls of wellbore 105. As a result, fluids may be produced from multiple intervals of the surrounding subterranean formation 120, in some embodiments via isolated portions of annulus 150 between adjacent pairs of production packers 135. The well screens 140 may be configured to filter fluids flowing into production tubing 130 from annulus 150.

Each of the one or more fluid flow control systems 145, in one or more embodiments, may include a fluid nozzle operable to receive production fluid having a pressure (P3) and discharge control fluid having a control pressure (P2). Further to the embodiment of FIG. 1, each of the one or more fluid flow control systems 145 may have an inflow control device having a production fluid inlet operable to receive the production fluid having the pressure (P3), a control inlet operable to receive the control fluid having the control pressure (P2) from the fluid nozzle, and a production fluid outlet operable to pass the production fluid to the tubing, the inflow control device configured to open or close the production fluid outlet based upon a pressure differential value (P3−P2).

Further to the embodiment of FIG. 1, each of the one or more fluid flow control systems 145 may have a flow regulator coupled to the inflow control device, the flow regulator configured to regulate a pressure drop (P3−P1) across the production fluid inlet and the production fluid outlet. tubular having one or more first openings therein, as well as a sliding member positioned at least partially within the tubular and having one or more second openings therein. In certain embodiments, the one or more fluid flow control systems 145 include a turbine, which ideally should always be spinning. The one or more fluid flow control systems 145, in at least one embodiment, adjust the flow volume of the fluid having the pressure (P3) such that the turbine receives a minimum amount of flow. In at least one embodiment, the one or more fluid flow control systems 145 adjust the flow volume of the fluid having the pressure (P3) such that the turbine is always spinning.

Figure 2:
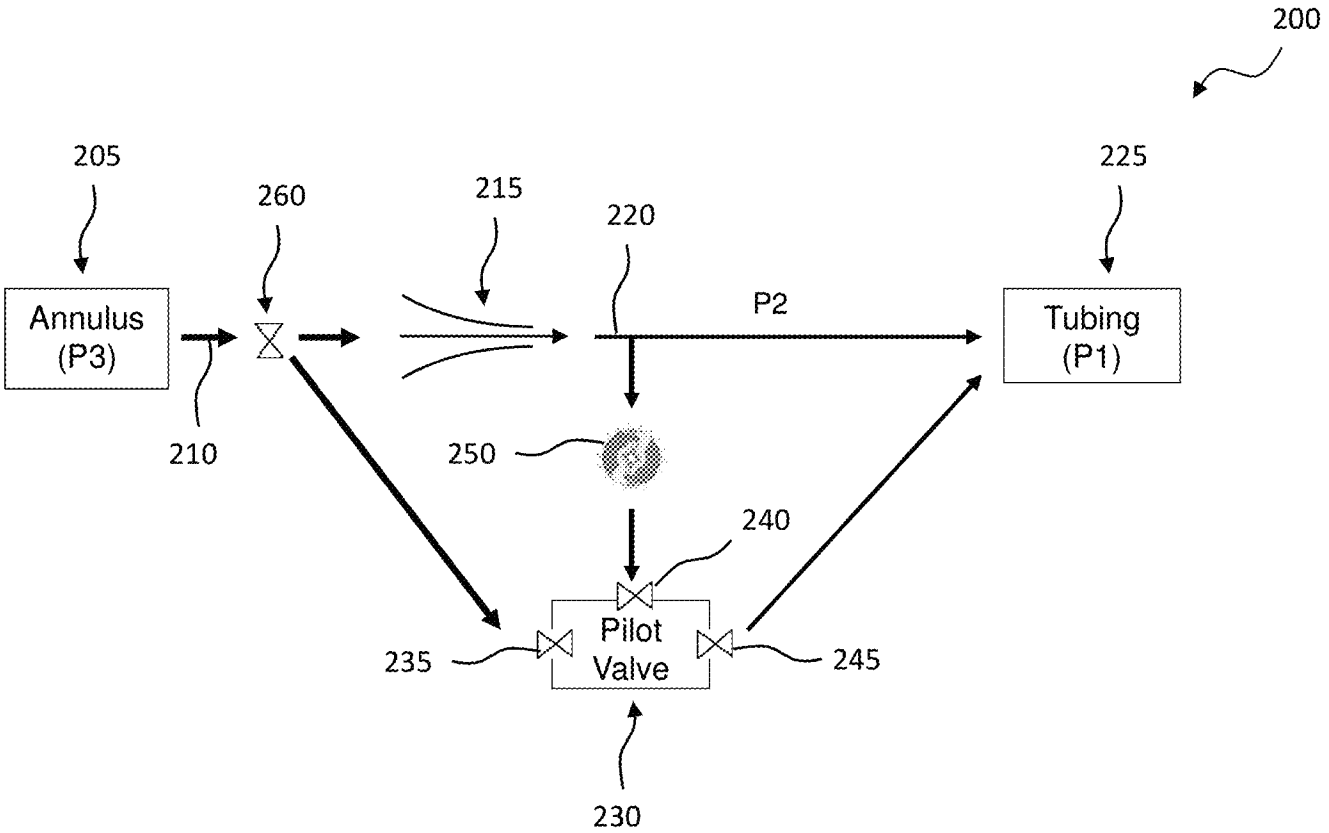
FIG. 2 illustrates a fluid flow control system designed, manufactured and operated according to one or more embodiments of the disclosure.

FIG. 2 illustrates a fluid flow control system 200 designed, manufactured and operated according to one or more embodiments of the disclosure. The fluid flow control system 200, in at least one embodiment, may include a fluid nozzle 215 operable to receive production fluid 210 (e.g., from an annulus 205) having a pressure (P3), and discharge control fluid 220 having a control pressure (P2).

The fluid flow control system 200 may additionally include an inflow control device 230, which in some embodiments may be a pilot valve. The inflow control device 230 may include a production fluid inlet 235 operable to receive the production fluid 210 (e.g., from an annulus 205) having a pressure (P3), a control inlet 240 operable to receive the control fluid 220 having the control pressure (P2) from the fluid nozzle 215, and a production fluid outlet 245 operable to selectively pass the production fluid having the pressure (P1) to the tubing 225. The inflow control device 230, in this embodiment, is thus configured to open or close the production fluid outlet 245 based upon a pressure differential value (P3−P2). The inflow control device 230 is additionally configured to have a pressure drop (P3−P1) across the production fluid inlet 235 and the production fluid outlet 245.

In certain embodiments, the inflow control system 200 additionally includes a turbine 250. The turbine 250, in at least one embodiment, is operable to receive fluid flow from the fluid nozzle 215 and pass (e.g., selectively pass in one embodiment) the control fluid 220 having the control pressure (P2) to the control inlet 240. In certain embodiments, the turbine 250 is operable to selectively pass the control fluid 220 based upon changes in density of the control fluid 220, and thus is a density selective turbine valve. For example, in at least one embodiment, if the turbine 250 senses that the control fluid 220 (e.g., which is representative of the production fluid 210) has a higher concentration of water than oil, the turbine 250 causes the inflow control device 230 to close. Alternatively, if the turbine 250 senses that the control fluid 220 (e.g., which is representative of the production fluid 210) has a higher concentration of oil than water, the turbine 250 causes the inflow control device 230 to open.

The inflow control system 200, in at least one embodiment, introduces a flow regulator 260 coupled to the inflow control device 230. In at least one embodiment, the flow regulator 260 is positioned between the annulus 205 and the inflow control device 230. The flow regulator 260, in one or more embodiments, is configured to regulate a pressure drop (P3−P1) across the production fluid inlet 235 and the production fluid outlet 245. For example, in at least one embodiment, the flow regulator 260 is configured to adjust a flow volume of the production fluid 210 having the pressure (P3) amongst the fluid nozzle 215 and the production fluid inlet 235, for example to regulate the pressure drop (P3−P1) across the production fluid inlet 235 and the production fluid outlet 245. The flow regulator 260, in one or more embodiments, is configured to adjust the flow volume of the production fluid 210 having the pressure (P3), such that the fluid nozzle 215 receives a minimum amount of flow. As the fluid flow control system 200 includes the turbine 250 in at least one embodiment, the flow regulator 260 could adjust the flow volume of the production fluid having the pressure (P3), such that the fluid nozzle 215 receive a minimum amount of flow to keep the turbine 250 spinning.

The flow regulator 260, thus in certain embodiments, is a flow diverter. In yet other embodiments, however, the flow regulator 260 is additionally a flow limiter. For example, certain instances may arise wherein the production fluid 210 having the pressure (P3) is too high for the inflow control device 230. In this scenario, the flow regulator 260 could limit the flow of the higher pressure production fluid 210 to the fluid nozzle 215 and the inflow control device 230. In limiting the flow, the flow regulator 260 could protect the fluid nozzle 215 and the inflow control device 230 from the higher pressure. In at least one embodiment, the limiting of the flow would help reduce erosive effects on either of the fluid nozzle 215 or the inflow control device 230.

FIGS. 3A through 3D illustrate a fluid flow control system 300 designed, manufactured and operated according to one or more alternative embodiments of the disclosure. The fluid flow control system 300 is similar in many respects to the fluid flow control system 200. Accordingly, like reference numbers have been used to illustrate similar features. The fluid flow control system 300, in contrast to the fluid flow control system 200, includes an alternative embodiment of a flow regulator 360 coupled to the inflow control device 230. The flow regulator 360, like the flow regulator 260, is also configured to regulate a pressure drop (P3−P1) across the production fluid inlet 235 and the production fluid outlet 245.

In the illustrated embodiment of FIGS. 3A through 3D, the flow regulator 360 includes a pressure regulating piston 370 that aligns with the production fluid inlet 235 and the fluid nozzle 215. In at least one embodiment, the pressure regulating piston 370 includes a first opening 380 extending there through, the first opening 380 operable to align (or misalign if that may be the case) with the production fluid inlet 235. In at least one other embodiment, the pressure regulating piston 370 includes a second opening 385 extending there through, the second opening 385 operable to align (or misalign if that may be the case) with the fluid nozzle 215.

As is illustrated, the pressure regulating piston 370 may extend through the production tubing 225 into the annulus 205. Accordingly, the pressure regulating piston 370 may be used to divert the production fluid having the pressure (P3) between the fluid nozzle 215 and the control inlet 235. In at least one embodiment, the flow regulator 360 includes a seal 390 coupled between the regulating piston 370 and the production tubing 225. The seal 390, in accordance with the disclosure, may have a seal area. The seal 390, in the illustrated embodiment, is an O-ring. However, other embodiments exist wherein other types of seals are used. For instance, in another embodiment, the seal 390 is a diaphragm having the seal area. The diaphragm, in one embodiment is a rubber diaphragm, and in another embodiment a metal diaphragm, without limitation. The diaphragm design advantageously eliminates any friction forces associated with the O-ring.

The flow regulator 360 of FIGS. 3A through 3D additionally includes a spring member 395. The spring member 395, in the illustrated embodiment, is coupled to the pressure regulating piston 370. In accordance with this embodiment, the spring member 395 is configured to set a location of the pressure regulating piston 370 relative to the pressure drop (P3−P1). For example, the spring member 395 might have a generally constant force across its travel, pushing the pressure regulating piston 370 to the left, while the pressure drop across the inflow control device 230 pushes the pressure regulating piston 370 to the right.

In at least one embodiment, the force of the spring member 395 would be equal to the desired pressure drop (P3−P1) across the production fluid inlet 235 and the production fluid outlet 245, multiplied by the aforementioned seal area. Therefore if the pressure drop (P3−P1) across the production fluid inlet 235 and the production fluid outlet 245 exceeds the desired value, the pressure would push the pressure regulating piston 370 to the right, opening up the effective production fluid inlet 235 diameter until the desired pressure drop is achieved. If the pressure drop is below the desired value, the spring member 395 would push the pressure regulating piston 370 to the left further restricting the effective production fluid inlet 235 diameter until the desired pressure drop is achieved.

The spring member 395 is illustrated as being positioned in the production tubing 225. Nevertheless, in at least one other embodiment, the spring member 395 is positioned in the annulus 205. It should further be noted that stops may be added to the flow regulator 360, such that the pressure regulating piston 370 stops when the production fluid inlet 235 is fully open, and/or stops before it is fully closed. In certain other embodiments, as discussed below with regard to FIG. 3D, no stops exist, and when the fluid flow control system 300 is overly pressured, the pressure regulating piston 370 moves very far to the right, fully closing the production fluid inlet 235 and the fluid nozzle 215. In an alternative embodiment, the pressure regulating piston 370 could be used to turn a valve (e.g., ball valve) upstream of the inflow control device 230. In yet another embodiment, the pressure regulating piston 370 could act like a needle on a needle valve, and choke the flow in order to reduce any sliding friction associated with the design of FIGS. 3A through 3D.

Figure 3A:
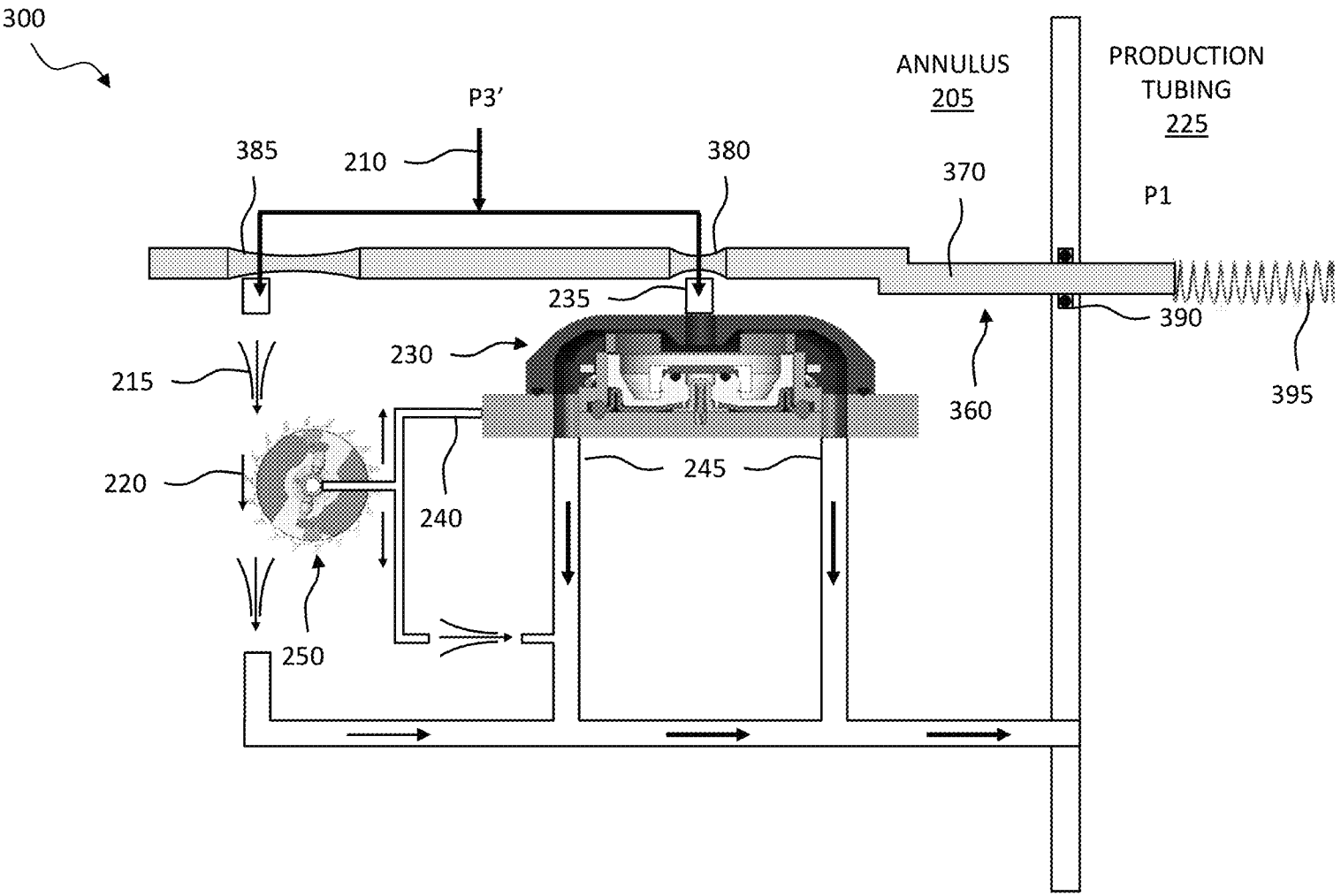
FIGS. 3A through 3D illustrate a fluid flow control system designed, manufactured and operated according to one or more alternative embodiments of the disclosure.

FIG. 3A illustrates the fluid flow control system 300 being subjected to a first pressure (P3'), wherein P3''''>P3'>P3''>P3'''. The first pressure (P3') is in a range of operation wherein the production fluid inlet 235 is receiving an entirety of its allowable flow volume. For instance, in the illustrated embodiment of FIG. 3A, the first opening 380 substantially aligns with the production fluid inlet 235. In at least one embodiment, the first opening 380 might substantially align with the production fluid inlet 235 when the first pressure (P3') ranges from about 80 psi to about 120 psi.

Figure 3B:
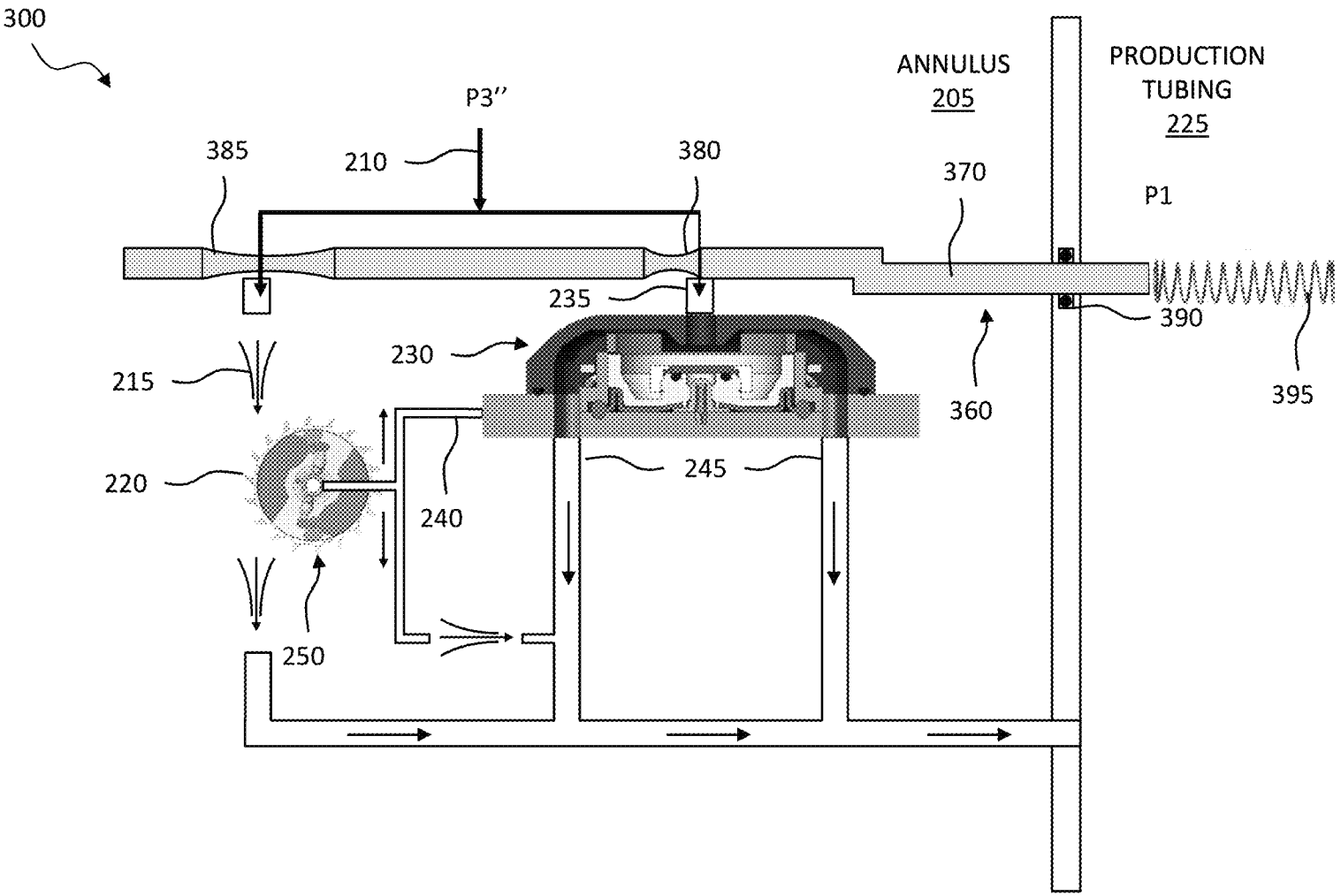

FIG. 3B illustrates the fluid flow control system 300 being subjected to a second lesser pressure (P3''). The second lesser pressure (P3'') is in a range of operation wherein the production fluid inlet 235 is receiving only a portion of its allowable flow volume. Accordingly, an additional portion of the flow volume (e.g., above what it would get in the embodiment of FIG. 3A) is being diverted to the fluid nozzle 215. For instance, in the illustrated embodiment of FIG. 3B, the first opening 380 only partially aligns with the production fluid inlet 235. In at least one embodiment, the first opening 380 might only partially align with the production fluid inlet 235 when the second lesser pressure (P3'') ranges from about 60 psi to about 80 psi.

Figure 3C:
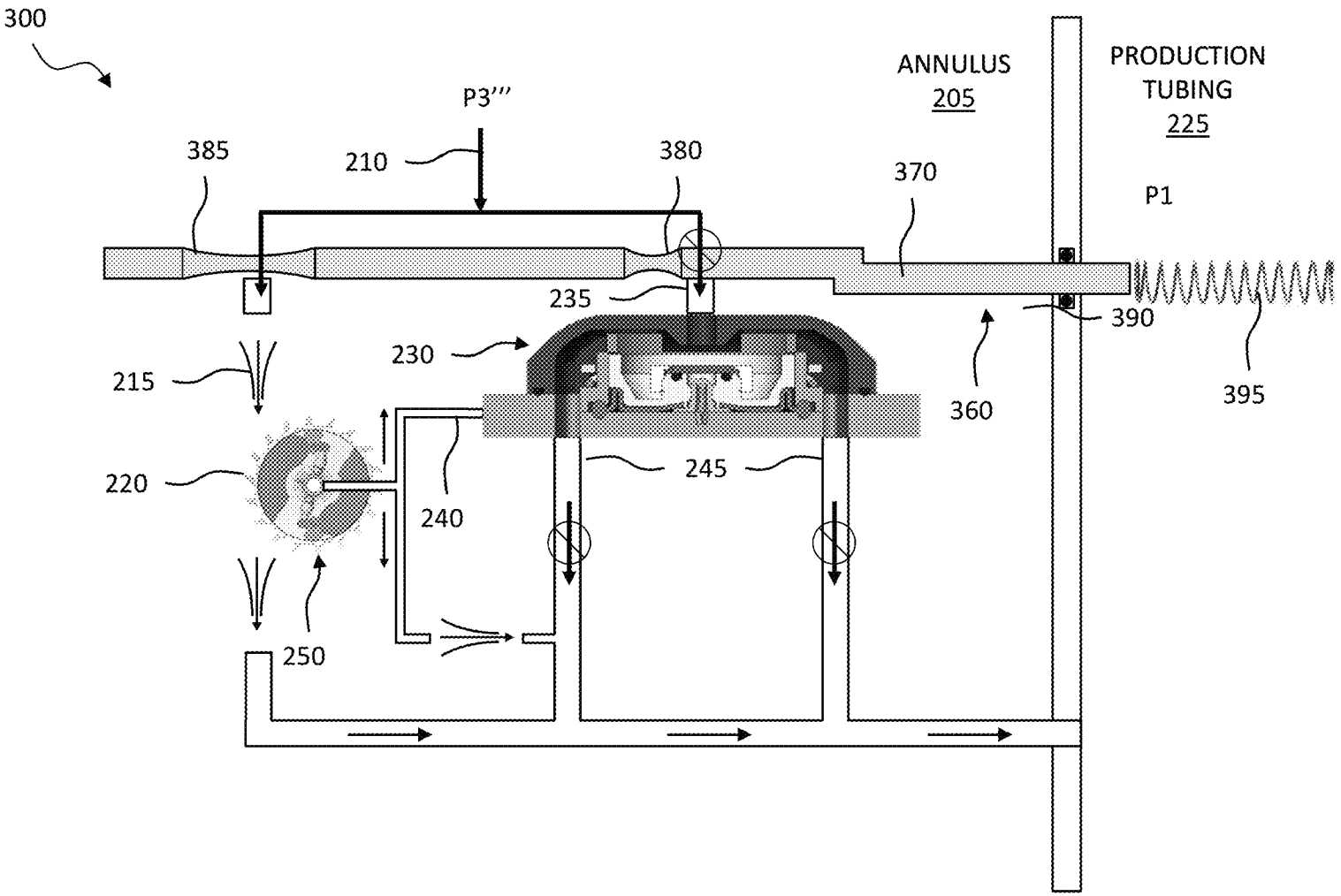

FIG. 3C illustrates the fluid flow control system 300 being subjected to yet an even third lesser pressure (P3'''). The third lesser pressure (P3''') is in a range of operation wherein the production fluid inlet 235 is receiving none of its allowable flow volume. Accordingly, all of the flow volume is being diverted to the fluid nozzle 215. For instance, in the illustrated embodiment of FIG. 3C, the first opening 380 is misaligned with the production fluid inlet 235. In at least one embodiment, the first opening 380 might misalign with the production fluid inlet 235 when the third lesser pressure (P3''') is below about 60 psi.

Figure 3D:
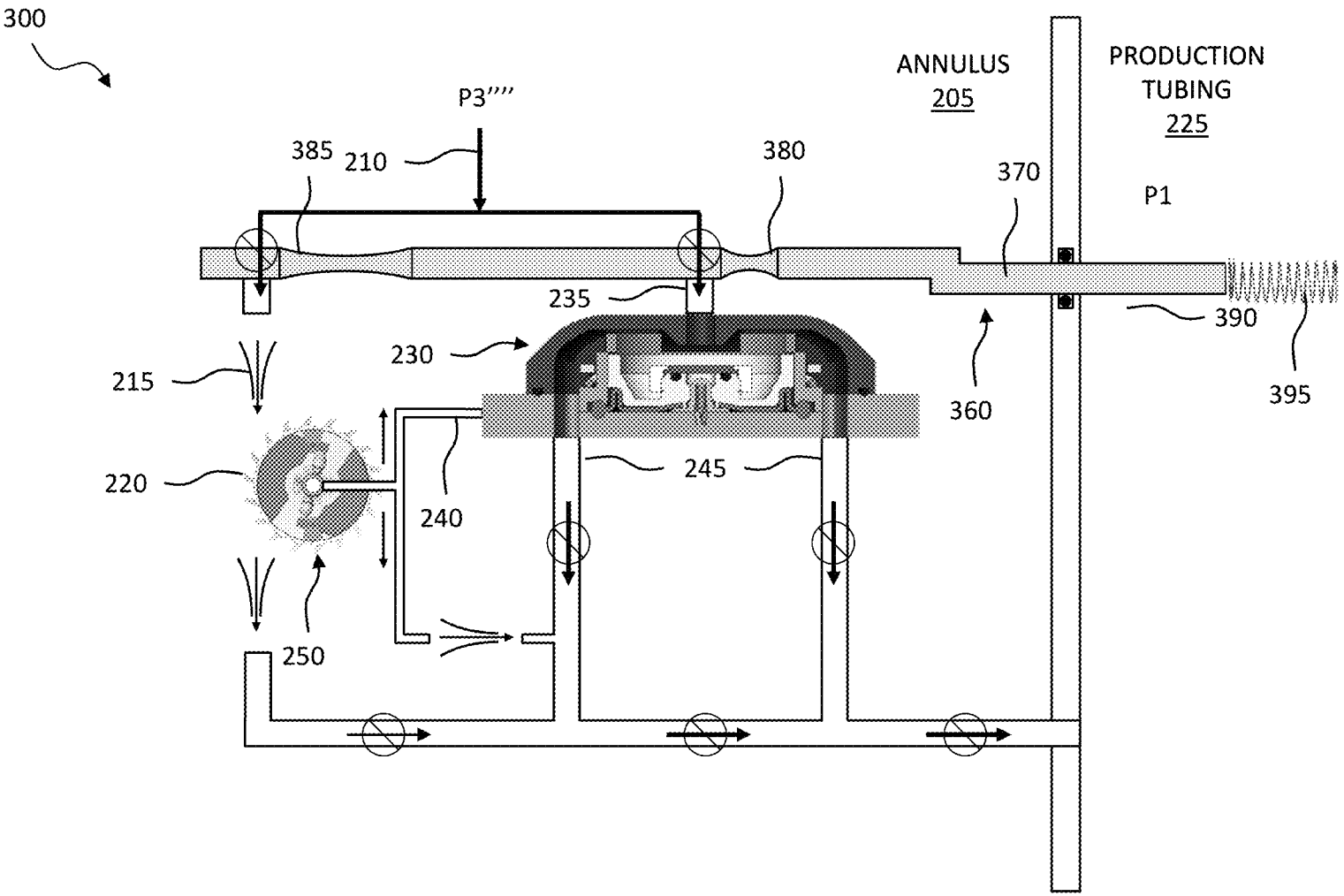

FIG. 3D illustrates the fluid flow control system 300 being subjected to a fourth greater pressure (P3''''). The fourth greater pressure (P3'''') is in a range of operation wherein the production fluid inlet 235 and/or the fluid nozzle 215 are receiving an extreme amount of flow volume and flow velocity. Accordingly, all of the flow volume is being shut off, for the safety of the fluid flow control system 300. For instance, in the illustrated embodiment of FIG. 3D, the first opening 380 is misaligned with the production fluid inlet 235, and the second opening 385 is misaligned with the fluid nozzle 215. In at least one embodiment, this might occur when the fourth greater pressure (P3'''') is above about 150 psi.

Aspects disclosed herein include:

A. A fluid flow control system, the fluid flow control system including: 1) a fluid nozzle operable to receive production fluid having a pressure (P3) and discharge control fluid having a control pressure (P2); 2) an inflow control device having a production fluid inlet operable to receive the production fluid having the pressure (P3), a control inlet operable to receive the control fluid having the control pressure (P2) from the fluid nozzle, and a production fluid outlet operable to pass the production fluid to the tubing, the inflow control device configured to open or close the production fluid outlet based upon a pressure differential value (P3−P2); and 3) a flow regulator coupled to the inflow control device, the flow regulator configured to regulate a pressure drop (P3−P1) across the production fluid inlet and the production fluid outlet.

B. A well system, the well system including: 1) a wellbore; 2) production tubing positioned within the wellbore, thereby forming an annulus with the wellbore; and 3) a fluid flow control system positioned at least partially within the annulus, the fluid flow control system including; a) a fluid nozzle operable to receive production fluid having a pressure (P3) from the annulus and discharge control fluid having a control pressure (P2); b) an inflow control device having a production fluid inlet operable to receive the production fluid having the pressure (P3), a control inlet operable to receive the control fluid having the control pressure (P2) from the fluid nozzle, and a production fluid outlet operable to pass the production fluid to the production tubing, the inflow control device configured to open or close the production fluid outlet based upon a pressure differential value (P3−P2); and c) a flow regulator positionable between the annulus and the inflow control device, the flow regulator configured to regulate a pressure drop (P3−P1) across the production fluid inlet and the production fluid outlet.

Aspects A and B may have one or more of the following additional elements in combination: Element 1: wherein the flow regulator is configured to adjust a flow volume of the fluid having the pressure (P3) amongst the fluid nozzle and the production fluid inlet to regulate the pressure drop (P3−P1) across the production fluid inlet and the production fluid outlet. Element 2: wherein the flow regulator is configured to adjust the flow volume of the fluid having the pressure (P3) such that the fluid nozzle receives a minimum amount of flow. Element 3: further including a turbine positioned between the fluid nozzle and the control inlet. Element 4: wherein the flow regulator is configured to adjust the flow volume of the fluid having the pressure (P3) such that the fluid nozzle receive a minimum amount of flow to keep the turbine spinning. Element 5: wherein the turbine is a density selective turbine valve. Element 6: wherein the flow regulator is a flow diverter. Element 7: wherein the flow regulator is a flow limiter. Element 8: wherein the flow regulator includes a pressure regulating piston. Element 9: wherein the pressure regulating piston extends through the tubing into the annulus to divert fluid between the fluid nozzle and the control inlet. Element 10: further including a seal coupled between the regulating piston and the tubing. Element 11: wherein the seal is an O-ring. Element 12: wherein the seal is a diaphragm. Element 13: wherein the diaphragm is a rubber diaphragm or a metal diaphragm. Element 14: further including a spring member coupled to the pressure regulating piston, the spring member configured to set a location of the pressure regulating piston relative to the pressure drop (P3–P1). Element 15: wherein the spring member is positioned in the tubing. Element 16: wherein the spring member is positioned in the annulus. Element 17: wherein the flow regulator is configured to adjust a flow volume of the fluid having the pressure (P3) amongst the fluid nozzle and the production fluid inlet to keep the fluid nozzle receiving a minimum amount of flow. Element 18: further including a turbine positioned between the fluid nozzle and the control inlet, and further wherein the flow regulator is configured to adjust the flow volume of the fluid having the pressure (P3) such that the fluid nozzle receive a minimum amount of flow to keep the turbine spinning.

Those skilled in the art to which this application relates will appreciate that other and further additions, deletions, substitutions and modifications may be made to the described embodiments.

What is claimed is:

1. A fluid flow control system, comprising:

a fluid nozzle operable to receive production fluid having a production fluid inlet pressure (P3) and discharge control fluid having a control pressure (P2);

an inflow control device having a production fluid inlet operable to receive the production fluid having the production fluid inlet pressure (P3), a control inlet operable to receive the control fluid having the control pressure (P2) from the fluid nozzle, and a production fluid outlet operable to pass the production fluid to production tubing, the inflow control device configured to open or close the production fluid outlet based upon a pressure differential value between the production fluid inlet pressure (P3) and the control pressure (P2); and an adjustable flow regulator coupled to the inflow control device, the flow regulator configured to regulate a pressure drop across the production fluid inlet pressure (P3) of the production fluid inlet and a production fluid outlet pressure (P1) of the production fluid outlet.

2. The fluid flow control system as recited in claim 1, wherein the flow regulator is configured to adjust a flow volume of the fluid having the production fluid inlet pressure (P3) amongst the fluid nozzle and the production fluid inlet to regulate the pressure drop across the production fluid inlet and the production fluid outlet.

3. The fluid flow control system as recited in claim 1, wherein the flow regulator is configured to adjust the flow volume of the fluid having the production fluid inlet pressure (P3) such that the fluid nozzle receives a minimum amount of flow.

4. The fluid flow control system as recited in claim 3, further including a turbine positioned between the fluid nozzle and the control inlet.

5. The fluid flow control system as recited in claim 4, wherein the flow regulator is configured to adjust the flow volume of the fluid having the production fluid inlet pressure (P3) such that the fluid nozzle receive a minimum amount of flow to keep the turbine spinning.

6. The fluid flow control system as recited in claim 5, wherein the turbine is a density selective turbine valve.

7. The fluid flow control system as recited in claim 1, wherein the flow regulator is a flow diverter.

8. The fluid flow control system as recited in claim 7, wherein the flow regulator is a flow limiter.

9. The fluid flow control system as recited in claim 1, wherein the flow regulator includes a pressure regulating piston.

10. The fluid flow control system as recited in claim 9, wherein the pressure regulating piston extends through the tubing into the annulus to divert fluid between the fluid nozzle and the control inlet.

11. The fluid flow control system as recited in claim 10, further including a seal coupled between the regulating piston and the tubing.

12. The fluid flow control system as recited in claim 11, wherein the seal is an O-ring.

13. The fluid flow control system as recited in claim 11, wherein the seal is a diaphragm.

14. The fluid flow control system as recited in claim 13, wherein the diaphragm is a rubber diaphragm or a metal diaphragm.

15. The fluid flow control system as recited in claim 10, further including a spring member coupled to the pressure regulating piston, the spring member configured to set a location of the pressure regulating piston relative to the pressure drop.

16. The fluid flow control system as recited in claim 15, wherein the spring member is positioned in the tubing.

17. The fluid flow control system as recited in claim 15, wherein the spring member is positioned in the annulus.

18. A well system, comprising:

a wellbore;

production tubing positioned within the wellbore, thereby forming an annulus with the wellbore; and a fluid flow control system positioned at least partially within the annulus, the fluid flow control system including;

a fluid nozzle operable to receive production fluid having a production fluid inlet pressure (P3) from the annulus and discharge control fluid having a control pressure (P2);

an inflow control device having a production fluid inlet operable to receive the production fluid having the production fluid inlet pressure (P3), a control inlet operable to receive the control fluid having the control pressure (P2) from the fluid nozzle, and a production fluid outlet operable to pass the production fluid to the production tubing, the inflow control device configured to open or close the production fluid outlet based upon a pressure differential value between the production fluid inlet pressure (P3) and the control pressure (P2); and an adjustable flow regulator positionable between the annulus and the inflow control device, the flow regulator configured to regulate a pressure drop across the production fluid inlet pressure (P3) of the production fluid inlet and a production fluid outlet pressure (P1) of the production fluid outlet.

19. The well system as recited in claim 18, wherein the flow regulator is configured to adjust a flow volume of the fluid having the production fluid inlet pressure (P3) amongst the fluid nozzle and the production fluid inlet to keep the fluid nozzle receiving a minimum amount of flow.

20. The well system as recited in claim 19, further including a turbine positioned between the fluid nozzle and the control inlet, and further wherein the flow regulator is configured to adjust the flow volume of the fluid having the production fluid inlet pressure (P3) such that the fluid nozzle receive a minimum amount of flow to keep the turbine spinning.

* * * * *